United States Patent [19]

Oly

[11] Patent Number: 4,655,873

[45] Date of Patent: Apr. 7, 1987

[54] DEVICE FOR APPLYING A WRAPPING TAPE AROUND AN OBJECT

[75] Inventor: Pieter J. Oly, Wormer, Netherlands

[73] Assignee: Sollas Holland, B.V., Wormer, Netherlands

[21] Appl. No.: 827,811

[22] Filed: Feb. 10, 1986

[30] Foreign Application Priority Data

Feb. 26, 1985 [NL] Netherlands ..... 8500540

[51] Int. Cl.[4] ..... B31F 5/00

[52] U.S. Cl. ..... 156/502; 53/58; 53/589; 100/26; 100/29; 100/32; 100/33 PB; 226/97

[58] Field of Search ..... 100/17, 25, 26, 29, 100/32, 33 R, 33 PB; 53/586, 589, 580, 399, 397; 226/95, 97; 406/106; 156/502

[56] References Cited

U.S. PATENT DOCUMENTS

| | | | |
|---|---|---|---|
| 2,913,270 | 10/1959 | Sachsenröder, Sr. et al. | 100/26 X |
| 3,564,810 | 2/1971 | Faletti et al. | 100/33 PB |
| 3,831,512 | 8/1974 | Johnson | 100/26 |
| 4,011,808 | 3/1977 | Aoki et al. | 100/26 |
| 4,120,239 | 10/1978 | Pasic et al. | 100/32 |

*Primary Examiner*—David Simmons
*Assistant Examiner*—Jeff Aftergut
*Attorney, Agent, or Firm*—Beehler, Pavitt, Siegemund, Jagger, Martella & Dawes

[57] ABSTRACT

A device for applying a wrapping tape (14) around an object (2), comprising a substantially closed trough (6) surrounding a support (1) for the object (2) to be wrapped, said trough (6) being adapted for guiding the tape (14) to be wrapped which is driven through said trough (6) by means of an air flow, clamping means (9) for temporarily retaining the free tape end (21), said trough (6) being adapted to be opened thereafter for releasing said tape (14), means (26; 25; 30) for tightening said tape (14) around said object (2) and returning it towards a buffer storage (19), means (19; 24) for attaching said tape end (21) to the opposite tape part and cutting loose the latter, means (22; 26) for refilling said storage (19) to the maximally required tape length, and control means for controlling said sequence of operations.

11 Claims, 6 Drawing Figures

DEVICE FOR APPLYING A WRAPPING TAPE AROUND AN OBJECT

Figure 1:
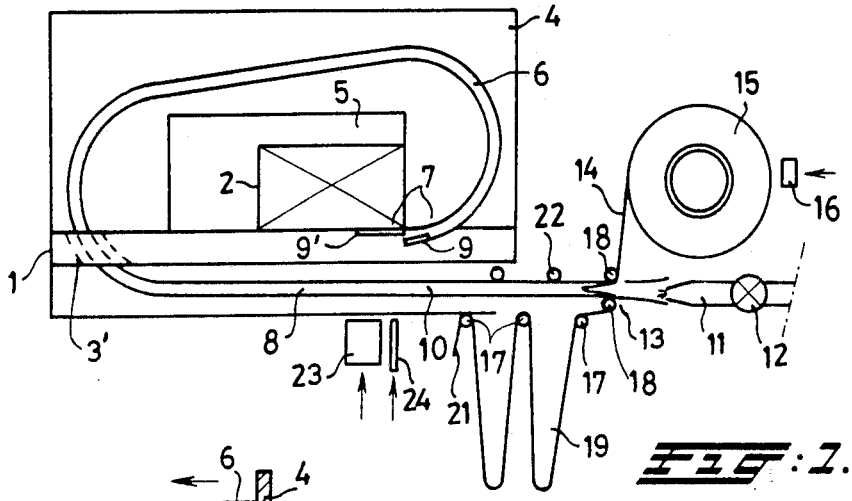

It is often required to wrap an object, and in particular a stack or bundle of separate objects, by means of a tape or the like.

For this purpose different kinds of devices are known, in which the tape is gripped by a gripper and is laid around the object. These known devices have certain disadvantages, such as a relatively slow operation and/or relatively much noise, and, furthermore, said devices are generally adapted to objects with definite dimensions, and cannot easily be adapted to objects with other dimensions.

It is an object of the invention to provide such a device, which can operate faster and more noiseless than the known devices, and, moreover, can wrap, without any adaptation, objects of widely varying dimensions and shapes, in which, in contrast to some known devices, the object is stationary, and, moreover, also objects of indefinite lengths, such as pipe bundles or the like, can be bundled.

The invention provides a device for providing a wrapping tape around an object, comprising a table for supporting the object to be wrapped, a supply means for the wrapping material, means for applying the supplied tape portion around said object, a means for adhering the free end of said tape to the portion thereof which has been tightened around said object, and a means for cutting the remainder of said wrapping tape from the adhered portion, which device is characterised in that, in an interruption of said table, a substantially vertically directed guiding trough in the shape of a substantially closed ring is arranged, said trough comprising a movable portion for opening said trough, the width of said trough being, in the closed condition, at least substantially equal to the width of a wrapping tape, in that one extremity of said trough near its other extremity joins a blowing nozzle, in that between said nozzle and the opening of said trough a passage for the wrapping tape originating from said supply is present, in that at the side of said passage remote from the supply side a container for a buffer storage is provided, the total length of the tape portion in the filled buffer storage being at least equal to the maximally required tape length, in that near the inner end of said trough a clamp for the free end of a tape and means for attaching and cutting of said tape are provided, in that near said buffer storage means are provided for leading backwards a tape portion laid around the object for tightening the same, in that means are provided for retaining the tape portion situated at the supply side, and in that means are provided for controlling a sequence of operations, comprising: retaining the supply portion of the tape, delivering an air flow through said nozzle so as to lead a rolling loop of said tape through the closed trough, said tape portion being pulled from said buffer storage until its free end has reached the other extremity of said trough, actuating said clamp at this extremity for retaining said tape end, opening the movable trough portion for releasing said tape, tightening said tape around said object while partly filling the buffer storage, attaching said tape, further filling the buffer storage from the supply after releasing the locking thereof, and cutting off the tape portion received in the buffer storage from the attached portion.

In the storage container a buffer storage is stored which is sufficient for wrapping the biggest prevailing object, and the excess tape length is led back to the buffer storage again so that no tape material is lost. Passing the tape through the trough by means of an air flow is very fast, and the object remains stationary so that wrapping can take place very quickly. If the object is to be provided with several tape straps, it is sufficient to shift said object after applying a strap over the required distance, and to repeat the above-mentioned sequence of operations. The dimensions of the objects to be wrapped are only restricted by the dimensions of the trough.

In a first embodiment, the buffer storage comprises a plurality of fixed supporting pins or rollers over which the tape can hang in downward loops, as well as vertically downwardly movable pulling pins or rollers situated between said supporting rollers, by means of which, after opening said trough, the tape can be tightened around the object, and after attaching the tape and releasing the tape portion at the supply side, the buffer storage can be replenished again.

For filling the buffer storage and/or tightening the tape around the object, also driven rollers to be engaged with the tape portions in question can be used, and, in particular, the roller or rollers for filling the buffer storage can be provided with a counter for controlling the correct filling of the storage.

In a special embodiment of such a device operating with supply rollers, the means for tightening the tape are formed by an auxiliary buffer container situated between the supply rollers and the supply means for the wrapping material, and in front of the opening of said auxiliary container a second blower nozzle is arranged which is adapted to tighten the tape portion laid around the object when the tape is released at the supply side and the trough is opened, and, in particular, said supply roller can be retracted during tightening so as to make the counter inoperative, said supply roller being made operative again when filling the main buffer storage, the filling thereof taking place, at first, from the auxiliary buffer storage, and, after emptying the latter, is completed from the tape supply.

In particular an additional clamp which can be opened and closed can be arranged between the buffer storage container and the attaching means, by means of which the tape can be frictionally gripped so as to tighten the tape still further when applying said clamp, the friction thereof being adjustable so as to allow, if required, to pull the tape from the main or auxiliary buffer storage, and blower nozzles can be provided for blowing away the free end of the tape.

In a first embodiment of said trough it has a substantially U-shaped cross-section with a lateral opening adapted to be contacted by a vertical stationary plate in order to close said trough, the latter being adapted to be laterally shifted for opening the trough.

In another embodiment of this trough it has, again, a substantially U-shaped cross-section, but the opening thereof is directed inwardly and the trough is fixedly mounted, a substantially ring-shaped wall being supported in a laterally movable manner, and closing, in one extreme position thereof, the opening of the trough.

The nozzle for blowing the tape through said trough can be made longitudinally movable in such a manner that, before the beginning of the blowing of the loop, it is moved towards the opening of the ring-shaped trough, thereby taking along a part of the tape portion present in the storage container until the opening of the trough has been reached, and subsequently the air flow is delivered.

Figure 2:
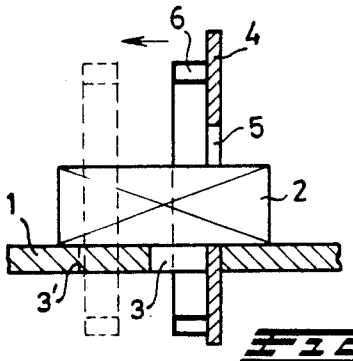
Figure 3:
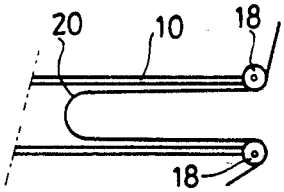
Figure 4:
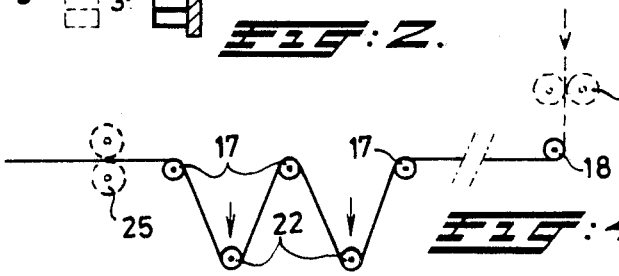
Figure 5:
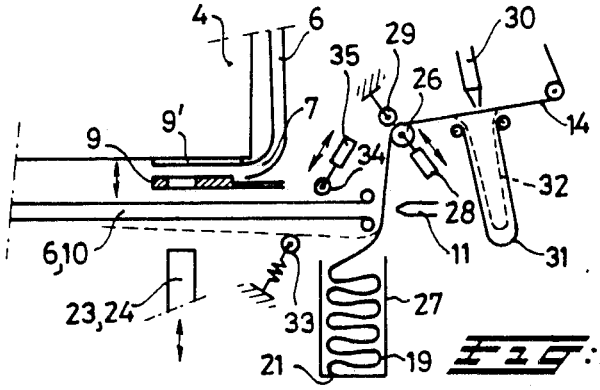
Figure 6:
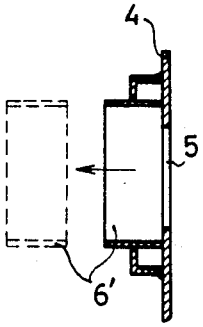

The invention will be elucidated below by reference to a drawing, showing in:

FIG. 1 a diagrammatical view of a first embodiment of the device according to the invention;

FIG. 2 a diagrammatical section of the device;

FIG. 3 a diagrammatical section of a part of a guiding trough of the device during blowing the tape therethrough;

FIG. 4 a diagrammatical view of a buffer storage container of this device during tightening of the tape;

FIG. 5 a diagrammatical view of a part of another embodiment of the device of FIG. 1; and FIG. 6 a section of another embodiment of the guiding trough of FIG. 1 or 5.

The device shown in FIG. 1 comprises a table 1 for supporting an object 2 to be wrapped, which object is, in particular, a stack or bundle of separate objects. This table is provided with an interruption 3 (FIG. 2), in which a fixed plate 4 is arranged which, for instance as shown, is connected at one side of the interruption to the table. In the plate 4 a rectangular window 5 is provided which is at least as large as the biggest object 2 to be wrapped.

Around the window 5 an annular trough 6 is arranged which is movable transversely to the plate 4, and has a rectangular C-shaped cross-section. In the operative position shown in FIG. 2 by continuous lines, this trough bears with its free terminal edges against the plate 4 so that a closed duct is formed, the width between the parallel sides being at least equal to the width of a wrapping tape to be provided around the object 2. As shown in FIG. 2 by interrupted lines, this trough can be shifted in respect of the plate 4 over a distance which is at least equal to the width of said tape, and, as shown at 3', adapted slots are provided in the table for this purpose. The extremities 7 and 8 of this trough are, as shown in FIG. 1, somewhat mutually staggered, the inner extremity being situated near a corner of the window 5. Furthermore a diagrammatically indicated clamp 9 is arranged near this extremity for retaining the end of a wrapping tape which is provided in the trough in a manner to be described below.

In alignment with the outer extremity 8 of the trough 6 an inlet trough 10 is situated which is movable together with the trough 6. In alignment with the former a blowing nozzle 11 is positioned which, by means of a valve 12, is connected to a source of compressed air not shown. Between said nozzle 11 and the trough 10 a passage 13 is located. As the case may be this nozzle can be movable together with the troughs 6 and 10.

Through the passage 13 a wrapping tape 14 is led which is unwound from a roll 15, which roll is provided with a diagrammatically shown brake 16. At the other side of said passage 13 a set of fixed guiding pins or rollers 18 is present, and, moreover, additional guiding rollers 18 can be provided for guiding the unwound tape 14; only two thereof are diagrammatically shown, but similar rollers can be arranged anywhere, where this is required for guiding the tape.

In the initial state shown in FIG. 1, the tape 14 hangs in loops on the pins 17, thus forming a buffer storage, the total tape length being slightly larger than the tape length required for being led through the trough 6. The dimensions of the biggest object which can be wrapped in this manner are then determined by the dimensions of the trough 6, or, in the case shown, of the window 5.

If, in the initial state shown in FIG. 1, in which the trough 6 is in the closed position shown in FIG. 2 by continuous lines, an air jet is delivered by the nozzle 11 by opening the valve 12 and, at the same time, the brake 16 retains the roll 15, the tape portion present in the passage 13 will, as diagrammatically shown in FIG. 3, be blown into the trough 10 in the form of a loop 20, the tape 14 being pulled away from the loops 19 of the buffer storage.

In practice a powerful air blast has proved to be sufficient for blowing the tape rapidly through the trough 6, even if said trough 6 is wider than the tape, so that said trough can also be used for tapes of different widths. It is, of course, also possible to use troughs of different widths or to make the walls of the trough adjustable if a precise guiding is desired.

Finally the end 21 of the tape contained in the storage 19 will reach the extremity 7 of the trough 6, where this end will then be gripped by the clamp 9. Thereafter the trough 6, as shown in FIG. 3 by interrupted lines, is opened, so that the tape will loosely lie around the object 2, and, by tensioning, can be tightened around said object.

For tightening the tape, pulling pins 22 are used which, as the inlet trough 10 has been pulled away, can be moved downwards between the guiding pins 17, as shown in FIG. 4, and the brake 16 continues to retain the roll 15. Then again loops 19 will be formed so that the buffer storage will be partly replenished again.

As soon as the tape has been pulled tightly around the object 2, a pressing head 23 is pushed upwards, which is possible since the trough 6 and the inlet trough 10 have been placed in the laterally shifted position.

The location of the head 23 is so that, as it is pushed upwards, the tape portion situated there is taken along, and will then be brought into contact with the free end 21 situated in the clamp 9, which clamp comprises a fixed pressing surface 9', with which the head 23 can co-operate, and which is, for instance, a part of the table 1.

The tape 14 consists, for instance, of thermoplastic material, or is provided with a thermoplastic coating. The head 23 comprises heating means adapted to soften the thermoplastic material to such an extent that the tape portions pressed together are interconnected.

While the head 23 is being pressed, the brake 16 is released, and the pins 22 are pushed downwards further until the loop length shown in FIG. 1 is reached, and then the pins 22 are retracted again until the position of FIG. 1 is reached. Thereafter a cutting knife 24 diagrammatically shown in FIG. 1 is actuated, which cuts the tape loose from the welded portion so that the free end 21 is produced. At the same time the clamp 9 is released. The object 2 can be removed then, and can be replaced by a nex object.

Filling the buffer storage 19 should be done within the time required for fixing the tape around the object, unless an auxiliary clamp is used retaining the loose end 21 until the buffer storage 19 has been filled again.

The various steps of this device are controlled by a suitable sequence controller, and, in particular, the filling of the storage 19 can be controlled by sensors for the force exerted on the pins 22 or by the lowest position attained thereby respectively. Moreover actuating the head 23, the cutting knife 24 and the brake 16 can be made dependent on the completion of the operation of a preceding element. Actuation of the valve 12 can be controlled by sensors for the presence of an object 2 on the table 1.

The use of a buffer storage 19 ensures that, irrespective of the dimensions of the object 2, there will always be a sufficient length of wrapping tape present, and partly replenishing this storage when tightening the tape around the object prevents loss of material. In particular it will then be possible to wrap successively objects of different dimensions without requiring additional adjustments.

It will be clear that within the scope of the invention many modifications are possible. For instance, the continuation 10 of the trough 6 can be left out, and then the nozzle 11 will be made longitudinally slidable, said nozzle then being shifted towards the left before the tape is blown through, and, at the same time, the tape 14 will be taken along from the storage 19 until the nozzle has been positioned in front of the initial part of the trough 6. Thereafter the tape is blown through by the air flow, and after blowing through the nozzle is retracted again, and then space for the head 23 and also for the pulling pins is provided.

It is also possible to bring about the tightening of the tape around the object by means of friction rollers to be engaged with said tape, which are shown in FIG. 4 by interrupted lines at 25. Also filling the buffer storage 19 can take place by means of such rollers, which are shown in FIG. 4 at 26; in that case the brake 16 can be omitted.

In FIG. 5 another embodiment of a part of the device of FIG. 1 is shown, wherein corresponding parts have been indicated by the same reference numerals as in FIG. 1. The buffer storage is now formed in a container 27, in which the tape, as shown, is received as loosely superposed and oppositely directed loops 19. The introduction takes place by means of a driven roller 26 which, by means of a pneumatic cylinder 28 or the like, can be pressed against a supported roller 29, the latter being coupled with a counter. As soon as the counter indicates that the buffer storage 19 has reached the desired length, the drive of the roller 28 is disconnected.

For tightening the tape laid around an object an auxiliary nozzle 30 is used which is situated between the supply of the tape 14 from the roll 15 and the driving roller 26. In front of said nozzle 30 a container 31 is situated.

As soon as the troughs 6 and 10 have been pulled aside, the roller 28 is removed from the counter-pressure roller 29, and an air blast is delivered by the nozzle 30 by means of which the excess portion of the tape is blown as a loop 32 into the container 31.

Between the head 23 and the adjacent edge of the container 27 a fixedly supported roller 33 and a cooperating rounded pressing head 34 with a driving means, for instance a pneumatic cylinder, are arranged. After opening the trough 6 and forming the auxiliary loops 32 in the container 31, said head 34 is pressed onwards so that the tape laid around the object is tightened still further. The roller 33 can rotate with an adjustable friction, said friction being adjusted so that, when exceeding the desired tensile stress in the tape portion laid around the object, the tape can be pulled from the auxiliary buffer 32. The rounded head 34 allows a sliding movement.

After cutting loose the tape end 21, the roller 26 is pressed against the roller 29 and is driven again. Then, at first, the rest of the loop 32 is taken along, and only thereafter the tape is further unwound from the roll 15. Also the portion 32 is counted then, so that the storage 19 will always have the same length.

The head 34 can be provided with air apertures by means of which, after cutting loose, the tape end 21 can be blown away so that it lands in the container 27.

The advantage of the auxiliary nozzle 30 is that the tape can be tightened by a short air blast, whereas actuating the pulling pins 22 of FIG. 1 by means of a pneumatic cylinder requires more air. In this manner a more restricted air storage and/or a smaller air pump can be used.

In FIG. 5 also a favourable embodiment of the clamp 9 is indicated, in which the counter-pressure surface 9' is a part of the clamp, which clamp possesses a passage for passing the head 23 and acts as a counter-pressure surface for the cutting knife 24.

FIG. 6 shows another embodiment of the trough 6 which is mainly fixedly connected to the wall 4, and which is open towards the inner side, which inner side can be closed by means of a slidable ring 6'.

It will be clear that within the scope of the invention many modifications are possible, and that elements described for one embodiment can also be used in the other embodiments.

What is claimed is:

1. A device for applying a wrapping tape around an object, comprising a table for supporting the object to be wrapped, a supply means for the wrapping material, means for applying the supplied tape portion around said object, a means for adhering the free end of said tape to the portion thereof which has been tightened around said object, and a means for cutting the remainder of said wrapping tape from the adhered portion, characterised in that, in an interruption (3) of said table (1), a substantially vertically directed guiding trough (6) for the wrapping tape (14) in the shape of a substantially closed ring is provided, said trough (6) comprising a movable portion for opening said trough, the width of said trough (6) being, in the closed condition, at least substantially equal to the width of a wrapping tape (14), in that one extremity (8,10) of this trough (6) near the other extremity (7) joins a blowing nozzle (11), in that between said nozzle (11) and the opening of said trough (6) a passage (13) for the wrapping tape (14) provided by said supply (18) is situated, in that, at the side of said passage (13) remote from the supply side (15), a container (19; 27) for a buffer storage is provided, the total length of the tape portion in the filled buffer storage (19) being at least equal to the maximally required tape length, in that, near the inner end (7) of said trough, a clamp (9) for the free end (21) of a tape (14), as well as means (23, 24) for attaching and cutting said tape (14) are provided, in that near said buffer storage container (19) means (22; 25; 30, 31) are provided for leading back a tape portion laid around said object for tightening the same, in that means (16; 26, 28, 29) are provided for retaining the tape portion situated at the supply side, and in that means are provided for controlling a sequence of operations, comprising: retaining the supply portion of the tape (14), delivering an air flow through said nozzle (11) so as to lead a rolling loop (20) of said tape (14) through the closed trough (6), said tape portion being pulled from said buffer storage (19) until its free end (21) has reached the other extremity (7) of said trough (6), actuating said clamp (9) at this extremity (7) for retaining said tape end (21), opening the movable trough portion for releasing said tape (14), tightening said tape (14) around said object (2) while partly filling the buffer storage (19, 32), attaching said tape (14), further filling the buffer storage (19) from the supply after releasing the locking thereof, and cutting off the attached tape portion from the portion received in the buffer storage (19).

2. The device of claim 1, characterised in that the buffer storage container (19) comprises a plurality of fixed supporting pins or rollers (17) over which the tape (14) can hang in downward loops, as well as vertically downwardly movable pulling pins or rollers (22) situated between said supporting pins or rollers (17), by means of which, after opening said trough (6), said tape (14) can be tightened around said object (2), and after attaching the tape end (21) and releasing the tape portion at the supply side, the buffer storage (19) can be replenished again from the supply means (15).

3. The device of claim 1 or 2, characterised in that, before filling the buffer storage (19) and/or tightening said tape (14) around said object (2), driven rollers (25, 26) to be engaged with the tape portions are used.

4. The device of claim 3, characterised in that the roll or rollers (26, 29) used for filling the buffer storage (19) are provided with a counter for controlling the filling of the buffer supply (19).

5. The device of claim 3, characterised in that the means for tightening said tape (14) are formed by an auxiliary buffer container (31) situated between the supply rollers (26, 29) and the supply means (15) for the wrapping material, a second blower nozzle (30) being arranged in front of the opening of said auxiliary container (31), and being adapted to tighten the tape portion laid around said object (2) when said tape (14) is retained at the supply side and the trough (6) is opened.

6. The device of claim 5, characterised in that the supply roller (26) is adapted to be retracted during tightening, so as to make said counter inoperative, said supply roller (26) being adapted to be made operative again when filling the main buffer storage (19), and filling said storage taking place, at first, from said auxiliary buffer storage (31), and is completed after emptying the latter from the tape supply (15).

7. The device of claim 1, characterised in that between said buffer supply container (19; 27) and the attaching means (23) an additional clamp (33, 34) is provided which can be opened and closed, and by means of which the tape (14) can be frictionally gripped just before applying the attaching means (23), so as to tighten said tape (14) when applying said attaching means (23) still further, the friction being adjustable so as to allow, if required, to pull said tape (14) after tightening from the main or auxiliary buffer storage (19; 32).

8. The device of claim 7, characterised in that a part (34) of said clamp is provided with blowing apertures.

9. The device of claim 1, characterised in that the trough (6) has a substantially U-shaped cross-section with a lateral opening adapted to be brought into contact with a vertical fixed plate (4) in order to close said trough (6), and adapted to be pulled aside for opening said trough (6).

10. The device of claim 1, characterised in that said trough (6) has a substantially U-shaped cross-section, the opening being directed towards the inner side, which trough (6) is fixedly mounted, and a substantially ring-shaped wall (6') being supported in a laterally movable manner, and closing, in one extreme position, the opening of said trough (6).

11. The device of claim 1, characterised in that the blower nozzle (11) is made longitudinally movable in such a manner that, before the beginning of the blowing of said loop (20) it is movable towards the opening of said annular trough (6), thereby taking along a part of the tape portion present in the storage container (19) until the opening of the trough (6) has been reached, and subsequently the air flow will be delivered.

* * * * *